US012330017B2

(12) United States Patent
Zhan et al.

(10) Patent No.: US 12,330,017 B2
(45) Date of Patent: Jun. 17, 2025

(54) LOWER-LIMB WALKING REHABILITATION TRAINER

(71) Applicant: SOOCHOW UNIVERSITY, Suzhou (CN)

(72) Inventors: Kuihua Zhan, Suzhou (CN); Zixian Qiu, Suzhou (CN); Yuhao Lu, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 270 days.

(21) Appl. No.: 17/801,312

(22) PCT Filed: Dec. 28, 2021

(86) PCT No.: PCT/CN2021/141922

§ 371 (c)(1),
(2) Date: Aug. 22, 2022

(87) PCT Pub. No.: WO2023/024374

PCT Pub. Date: Mar. 2, 2023

(65) Prior Publication Data

US 2023/0321480 A1 Oct. 12, 2023

(30) Foreign Application Priority Data

Aug. 26, 2021 (CN) ..... 202110990617.2

(51) Int. Cl.
*A63B 22/00* (2006.01)

(52) U.S. Cl.
CPC ..... *A63B 22/0056* (2013.01); *A63B 22/0046* (2013.01); *A63B 2022/0038* (2013.01); *A63B 2022/0094* (2013.01); *A63B 2225/09* (2013.01)

(58) Field of Classification Search
CPC ..... A63B 22/0056; A63B 22/0046; A63B 2022/0038; A63B 2022/0094;
(Continued)

(56) References Cited

U.S. PATENT DOCUMENTS 5,290,211 A * 3/1994 Stearns ..... A63B 22/001 482/53
6,966,869 B1 * 11/2005 Stearns ..... A63B 22/001 482/52

(Continued)

FOREIGN PATENT DOCUMENTS

CN 103519974 A 1/2014
CN 113133907 A 7/2021

(Continued)

*Primary Examiner* — Megan Anderson
*Assistant Examiner* — Catrina A Letterman
(74) *Attorney, Agent, or Firm* — SZDC Law PC

(57) ABSTRACT

The invention provides a lower-limb walking rehabilitation trainer, including two supporting frames, two gait simulation mechanisms installed on the two supporting frames respectively, and two pedals installed on the two gait simulation mechanisms respectively. The supporting frames are crutch type supporting frames. The gait simulation mechanisms include a special four-bar linkage and curve amplification mechanism. The four-bar linkage consists of a crank, a first connecting rod, a rocking rod and a rack rod that are articulated end to end. The upper end of the first connecting rod is articulated with the lower end of the second connecting rod in the curve amplification mechanism, the lower end of the third connecting rod in the curve amplification mechanism is articulated with the pedal, the rack rod is relatively fixed to the supporting frame, and the fourth connecting rod is connected to the inner side of the crutch type supporting frame.

8 Claims, 5 Drawing Sheets

(58) Field of Classification Search
CPC . A63B 2225/09; A63B 25/00; A63B 21/4011; A63B 23/04; A63B 2022/067; A63B 2022/0676; A63B 2022/0682; A63B 2022/0688; A63B 2208/0204; A63B 2213/00; A63B 23/0464; A63B 23/0458; A63B 23/0429; A63B 23/0405; A63B 23/0417; A63B 23/0423; A63B 2023/0452; A63B 2023/0447; A63B 2023/0441; A63B 22/0664–0694; A61H 1/0237; A61H 1/0255; A61H 1/0259; A61H 1/0262; A61H 2201/14; A61H 2201/164; A61H 3/008; A61H 3/02; A61H 3/00
See application file for complete search history.

(56) References Cited

U.S. PATENT DOCUMENTS

| | | | | |
|---|---|---|---|---|
| 2002/0019298 | A1* | 2/2002 | Eschenbach | A63B 22/0664 482/52 |
| 2017/0136295 | A1* | 5/2017 | Tholkes | A61B 5/112 |
| 2017/0144016 | A1* | 5/2017 | Gordon | A63B 21/0087 |
| 2020/0114199 | A1* | 4/2020 | Lee | A63B 21/4035 |
| 2024/0033158 | A1* | 2/2024 | Eidelberg | A61H 1/0262 |

FOREIGN PATENT DOCUMENTS

| | | | |
|---|---|---|---|
| CN | 113599782 | A | 11/2021 |
| GB | 2413093 | A | 10/2005 |
| JP | 2008253539 | A | 10/2008 |

* cited by examiner

LOWER-LIMB WALKING REHABILITATION TRAINER

This application is the National Stage Application of PCT/CN2021/141922, filed on Dec. 28, 2021, which claims priority to Chinese Patent Application No. 202110990617.2, filed on Aug. 26, 2021, which is incorporated by reference for all purposes as if fully set forth herein.

FIELD OF THE INVENTION

The present invention relates to the technical field of limb rehabilitation therapy equipment, and more particularly to a lower-limb walking rehabilitation trainer.

DESCRIPTION OF THE RELATED ART

In recent years, using a lower limb rehabilitation trainer to help patients with lower limb dyskinesia to exercise lower limb muscle strength and improve walking ability has become an important means of clinical rehabilitation therapy. The rehabilitation equipment currently used mainly includes two types, the exoskeleton wearable robot and the pedal rehabilitation trainer.

The exoskeleton wearable robot represents an important direction of development of limb rehabilitation equipment at present, and its training mode is the best choice for patients with limb paralysis and without walking ability, and cannot be replaced by other rehabilitation methods. However, the modular training method dominated by equipment tends to make patients get used to the exercise of decomposed limb movements. For patients who have partial movement ability and need to improve the coordination of limb movements, this method is not targeted enough, and the excessive dependence on biofeedback signals is not good for them to consciously stimulate muscle vitality, get rid of the assistance of equipment as soon as possible, and restore their autonomous walking ability.

The exoskeleton wearable robot has a large footprint and expensive price, needs professional expertise and is professionally demanding. In contrast, a pedal trainer has the advantages of small footprint, low cost and simple operation. At present, gait training of the vast majority of lower limb rehabilitation training equipment is based on the gait characteristics of a normal person walking on the treadmill, providing the guidance of gait training for patients, and has a pointed feather-shaped gait trajectory. However, compared with being able to "stride" on the treadmill, to improve the walking ability of patients with walking disorders, it is more necessary to first achieve the rehabilitation goal of "stepping" on the ground. Therefore, it is an urgent problem for those skilled in the art to provide a foot exercise trainer with guidance by the gait trajectory of "stepping" on the ground.

SUMMARY OF THE INVENTION

In view of this, the technical problem to be addressed by the present invention is to overcome the drawbacks of the lower-limb walking rehabilitation machines in prior art and technically achieve "stepping" type gait trajectory planning, simply the structure of the pedal type trainer, and reduce the production cost.

To address the technical problems mentioned above, the present invention provides a lower-limb walking rehabilitation trainer, including two supporting frames, two gait simulation mechanisms installed on the two supporting frames respectively, and two pedals installed on the two gait simulation mechanisms respectively. The supporting frames are crutch type supporting frames and the pedals are shoe cover type pedals. The gait simulation mechanism includes:

a four-bar linkage including a crank, a first connecting rod, a rocking rod and a rack rod, a lower end of the first connecting rod being rotatably connected to one end of the crank via a hinge, the other end of the crank being rotatably connected to one end of the rack rod via a hinge, the other end of the rack rod being articulated with a lower end of the rocking rod, an upper end of the rocking rod being connected to the first connecting rod via a hinge, the connecting point being the middle point of the first connecting rod;

a curve amplification mechanism including a second connecting rod, a third connecting rod, a fourth connecting rod and a short connecting rod, the second connecting rod being articulated with one end of the short connecting rod, the connecting point being the middle point of the second connecting rod, the other end of the short connecting rod being articulated with the body of the third connecting rod, an upper end of the second connecting rod being articulated with the body of the fourth connecting rod, an upper end of the third connecting rod being articulated with a lower end of the fourth connecting rod, the second connecting rod and the third connecting rod being arranged parallel to each other, the short connecting rod and the fourth connecting rod being arranged parallel to each other;

in which the upper end of the first connecting rod in the four-bar linkage is articulated with the lower end of the second connecting rod in the curve amplification mechanism, the lower end of the third connecting rod in the curve amplification mechanism is articulated with the pedal, the rack rod of the four-bar linkage is relatively fixed to the supporting frame, the upper end of the fourth connecting rod in the curve amplification mechanism is connected to the inner side of the crutch type supporting frame via a fixed hinge, and the articulation point is vertically aligned with the articulation point at the lower end of the rocking rod; and in the working state, the supporting frames are fixed to the ground.

Preferably, the trajectory generated by the upper end of the first connecting rod in the four-bar linkage has five-point contact with the horizontal line.

Preferably, the proportional relationship of size between the trajectory generated by the lower end of the third connecting rod in the curve amplification mechanism and the trajectory generated by the upper end of the first connecting rod in the four-bar linkage is 9.5:6.

Preferably, the proportional relationship of rod length between the crank, the first connecting rod, the rocking rod and the rack rod is 1:8:4:3.

Preferably, the proportional relationship of rod length between the second connecting rod, the third connecting rod, the fourth connecting rod and the short connecting rod is 6:9.5:9.5:3.5.

Preferably, the cranks of the two gait simulation mechanisms are in transmission connection with each other via a transmission shaft and the crank of one of the gait simulation mechanisms is driven by the motor in uniform rotation.

Preferably, the rotational angle difference between the cranks of the two gait simulation mechanisms is 180°.

Preferably, the driven rotational speed of the crank is adjustable.

Preferably, the crutch type supporting frame includes a supporting rod, a soft-roll supporting pad installed at the upper end of the supporting rod for underarm support, an armrest installed at the lower end of the supporting rod and a fixed support arranged between the armrest and the ground for fixing the whole crutch type supporting frame, the inner side of the supporting rod being connected to the fourth connecting rod in the gait simulation mechanism via a fixed hinge, the connection point being vertically aligned with the articulation point at the lower end of the rocking rod.

Preferably, the length of the supporting rod can be adjusted by the rod length adjustment mechanism provided on the supporting rod.

Compared with prior art, the technical solution of the present invention as described above has the following advantages.

1) In the lower-limb walking rehabilitation trainer disclosed by the present invention, the gait simulation mechanisms according to the present invention allow the feet of the patient to follow the shell like movement trajectory of the pedals in walking training that simulates "stepping" on the ground. Through continuous "stepping" training, the vitality and coordination ability of the muscle groups required for the legs to take off and land alternately when walking on the ground is enhanced. Meanwhile, with the help of the muscle strength of the upper limbs, the body can be balanced by underarm support, and the movement ability of lower limb joints can be brought into play to complete the double-legged walking action guided by the feet.
2) In the lower-limb walking rehabilitation trainer disclosed by the invention, the movement trajectory of the connection point between the gait simulation mechanism and the pedal according to the invention has five-point contact with the horizontal straight line, and as the position corresponding to the foot ankle, can ensure that during the time period where maximum force is exerted by the supporting foot in pressing down and striding, the displacement, velocity and acceleration of the ankle of the supporting foot in the direction perpendicular to the ground are zero, thereby effectively preventing additional impact on the foot by the equipment and secondary damage to the limb caused thereby.
3) The lower-limb walking rehabilitation trainer disclosed by the invention only controls the movement track of the ankle joint position, and for patients with partial lower limb movement ability, it can stimulate and enhance their ability of movement coordination among joints of lower limbs while making the patients familiar with normal walking posture and correcting their abnormal gait.

BRIEF DESCRIPTION OF THE DRAWINGS

In order to make the content of the present invention more clearly understood, the present invention will be explained in further detail below according to particular embodiments of the present invention and with reference to the accompanying drawings, in which.

REFERENCE NUMBERS IN THE DRAWINGS

Figure 1:
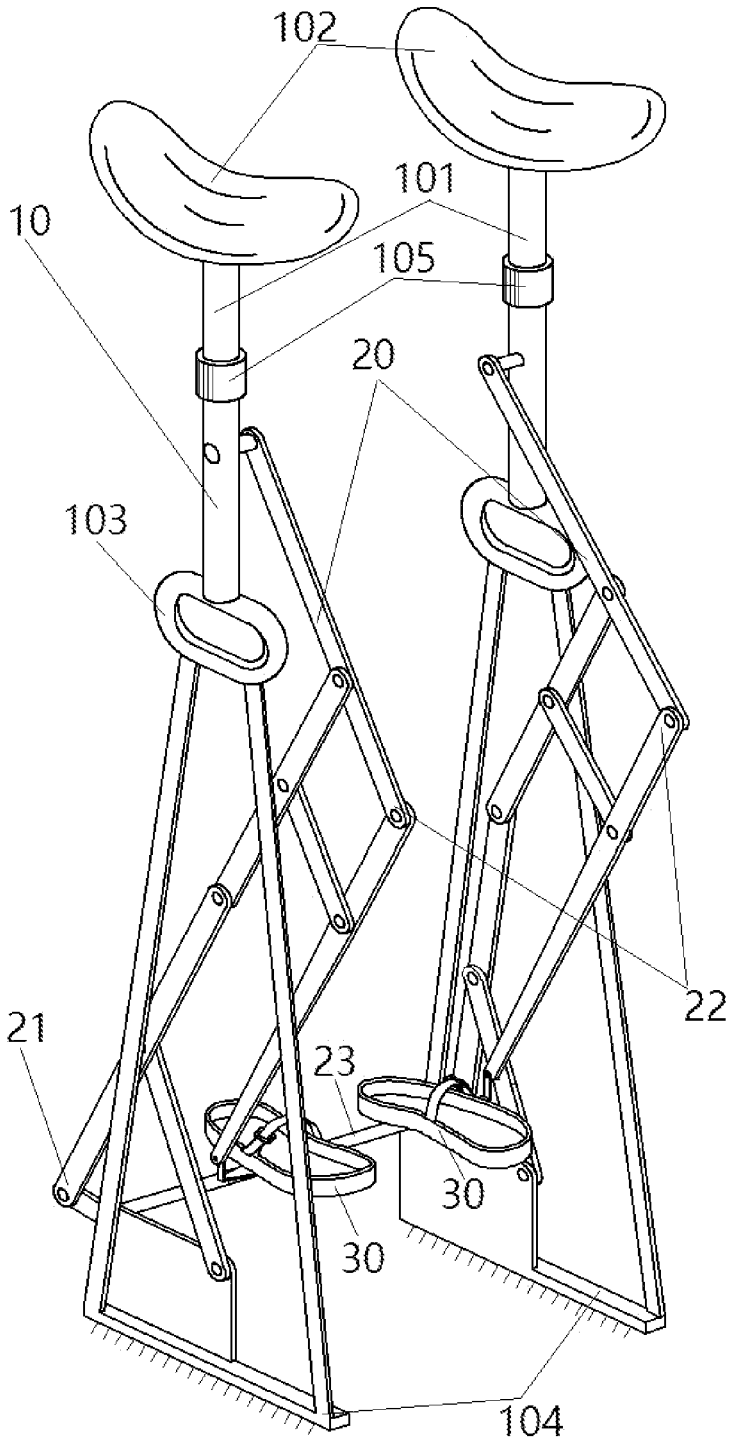
FIG. 1 is a schematic structural view of a lower-limb walking rehabilitation trainer according to the present invention.
Figure 2:
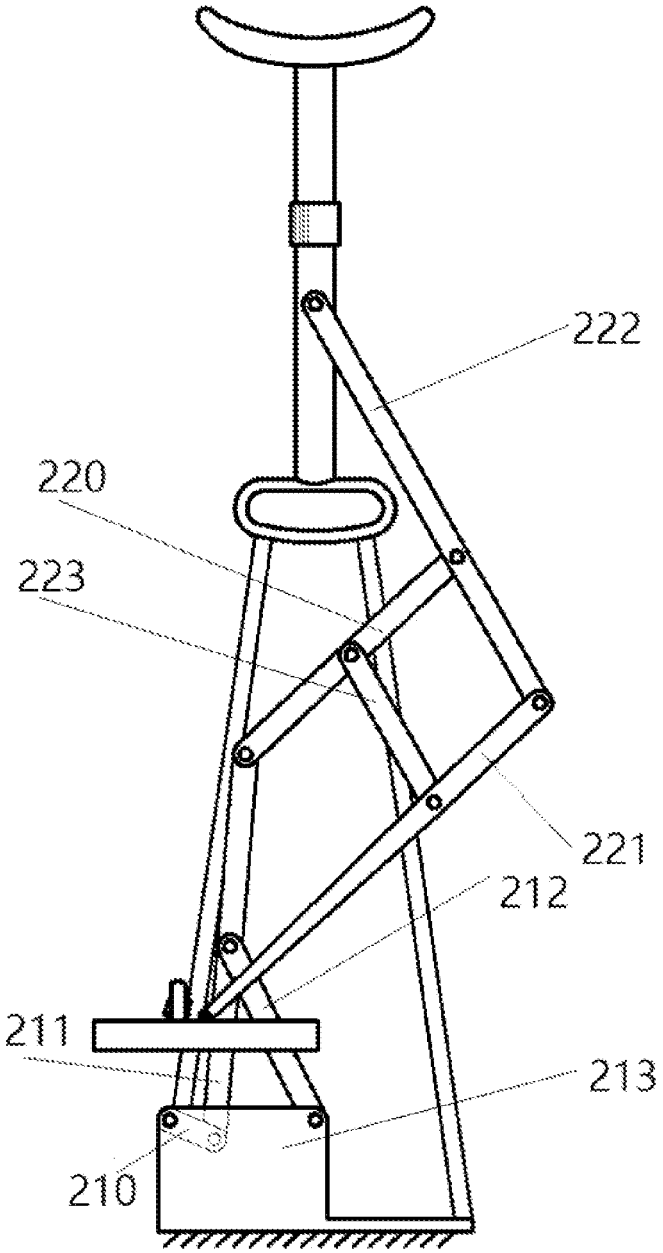
FIG. 2 is a full view of a left-foot device of a lower-limb walking rehabilitation trainer according to the present invention.

10 supporting frame; 101 supporting rod; 102 soft-roll supporting pad; 103 armrest; 104 fixed support; 105 rod length adjustment mechanism; 20 gait simulation mechanism; 21 four-bar linkage; 210 crank; 211 first connecting rod; 212 rocking rod; 213 rack rod; 22 curve amplification mechanism; 220 second connecting rod; 221 third connecting rod; 222 fourth connecting rod; 223 short connecting rod; 30 pedal; 40 trajectory point of the upper end of the first connecting rod/trajectory point of the lower end of the second connecting rod; 41 trajectory of the upper end point of the first connecting rod; 42 trajectory point of the lower end of the third connecting rod; 43 trajectory of the lower end point of the third connecting rod; 50 movement point of the right foot; 51 movement point of the left foot.

DETAILED DESCRIPTION OF THE PREFERRED EMBODIMENTS

The invention will be further explained with reference to the drawings and particular embodiments in the following, so that those skilled in the art can better understand and implement the present invention. However, the listed embodiments shall not be taken as limitation of the present invention.

Referring to FIGS. 1-8, a lower-limb walking rehabilitation trainer includes two supporting frames 10, two gait simulation mechanisms 20 installed on the two supporting frames 10 respectively, and two pedals 30 installed on the two gait simulation mechanisms 20 respectively. The supporting frames 10 are crutch type supporting frames and the pedals 30 are shoe cover type pedals.

The gait simulation mechanisms 20 each include:

- a four-bar linkage 21 including a crank 210, a first connecting rod 211, a rocking rod 212 and a rack rod 213, wherein lower end of the first connecting rod 211 is rotatably connected to one end of the crank 210 via a hinge, the other end of the crank 210 is rotatably connected to one end of the rack rod 213 via a hinge, the other end of the rack rod 213 being articulated with a lower end of the rocking rod 212, an upper end of the rocking rod 212 is connected to the first connecting rod 211 via a hinge, the connecting point is the middle point of the first connecting rod 211; and
- a curve amplification mechanism including a second connecting rod 220, a third connecting rod 221, a fourth connecting rod 222 and a short connecting rod 223, wherein the second connecting rod 220 is articulated with one end of the short connecting rod 223, the connecting point is the middle point of the second connecting rod 220, the other end of the short connecting rod 223 is articulated with the body of the third connecting rod 221, the upper end of the second connecting rod 220 is articulated with the body of the fourth connecting rod 222, the upper end of the third connecting rod 221 is articulated with the lower end of the fourth connecting rod 222, the second connecting rod 220 and the third connecting rod 221 are arranged parallel to each other, the short connecting rod 223 and the fourth connecting rod 222 are arranged parallel to each other.

The upper end of the first connecting rod 211 in the four-bar linkage 21 is articulated with the lower end of the second connecting rod 220 in the curve amplification mechanism 22, the lower end of the third connecting rod 221 in the curve amplification mechanism 22 is articulated with the pedal 30, the rack rod 213 in the four-bar linkage 21 is relatively fixed to the supporting frame 10, the upper end of the fourth connecting rod 222 in the curve amplification mechanism 22 is connected to the inner side of the crutch type supporting frame via a fixed hinge, and the articulation point is vertically aligned with the articulation point at the lower end of the rocking rod 212.

In the working state, the supporting frames 10 are fixed to the ground.

In the above, the gait simulation mechanisms allow the feet of the patient to follow the shell like movement trajectory of the pedals in training that simulates walking on the ground, and the trajectory is in a similar form to the movement trajectory of the ankle of a normal person in "stepping" type walking. Through continuous "stepping" training, the vitality and coordination ability of the muscle groups required for the feet to take off and land alternately when walking on the ground is enhanced. Meanwhile, with the help of the muscle strength of the upper limbs, the body can be balanced by underarm support, and the movement ability of lower limb joints can be brought into play to complete the double-legged walking action guided by feet.

Preferably, the trajectory 41 generated by the first connecting rod 211 in the four-bar linkage 21 has five-point contact with the horizontal line.

Preferably, the proportional relationship of size between the trajectory 43 generated by the curve amplification mechanism 22 and the trajectory 41 generated by the four-bar linkage 21 is 9.5:6.

Preferably, the proportional relationship of rod length between the crank 210, the first connecting rod 211, the rocking rod 212 and the rack rod 213 is 1:8:4:3.

Preferably, the proportional relationship of rod length between the second connecting rod 220, the third connecting rod 221, the fourth connecting rod 222 and the short connecting rod 223 is 6:9.5:9.5:3.5.

In the above, different size settings correspond to different amplification factors to adapt to the demand for walking stride by different patients.

Preferably, the cranks 210 of the two gait simulation mechanisms are in transmission connection with each other via a transmission shaft 23 and the crank 210 of one of the gait simulation mechanisms descried above is driven by the motor in uniform-speed rotation.

Preferably, the rotational angle difference between the cranks 210 of the two gait simulation mechanisms is 180°.

In the above, the cranks of the two gait simulation mechanisms have a rotational angle difference of 180° so as to ensure the same form of trajectory of movement points of the feet and alternate movement of equal time of the feet.

Preferably, the driven rotational speed of the crank 210 described above is adjustable.

In the above, the driven rotational speed of the crank is adjustable to adapt to the demand for walking speed by different patients.

Preferably, the crutch type supporting frames 10 each include a supporting rod 101, a soft-roll supporting pad 102 installed at the upper end of the supporting rod 101 for underarm support, an armrest 103 installed at the lower end of the supporting rod 101 and a fixed support 104 provided between the armrest 103 and the ground to retain the whole crutch type supporting frame, the inner side of the supporting rod 101 being connected to the fourth connecting rod 222 in the gait simulation mechanisms 20 via a fixed hinge.

In the above, the body is balanced by using the underarm support method, and with the help of the muscle strength of the upper limbs and the activity ability of the lower limb joints, the double-legged walking action guided by the feet is completed. The exertion of one's own muscle ability is helpful to improve the confidence in rehabilitation and the enthusiasm for training. At the same time, a feeling of affinity is established between the patients and the trainer by use of the crutch style, which helps the patients to smoothly enter the next rehabilitation stage of walking independently on the ground with crutches, thereby shortening the time of equipment assistance.

Preferably, the length of the supporting rod 101 can be adjusted by the rod length adjustment mechanism 105 provided on the supporting rod 101.

In the above, the length can be adjusted to adapt to the demand for height of the supporting pad by different patients.

The operation principle of the present invention: two gait simulation mechanisms 20 are installed on the inner side of the crutch-type bracket to control the movement posture of the left and right foot respectively. One of the cranks 210 of the gait simulation mechanism 20 is driven by the motor in uniform-speed rotation and the other crank 210 is driven by the transmission shaft 23 in rotation. The two cranks keep a phase difference of 180°. The lower ends of the third connecting rods 221 in the two gait simulation mechanisms 20 make alternate "stepping" like movements. A pair of shoe-cover type pedals is installed with the position of the lower end of the third connecting rods 221 in the gait simulation mechanisms as the reference for the level of the ankles to bind the feet, so that the feet of the patient can perform gait rehabilitation training according to the trajectory of a normal person walking on the ground.

Description of a Gait Trajectory Generating Mechanism:

The present invention provides a four-bar linkage that can generate a shell like trajectory in five-point contact with the tangent thereof. The higher order of contact the gait trajectory is in with a straight line, the closer the feet are to the ground, and the smaller the impact is, thereby preventing secondary damage to the limbs of the patient.

Figure 3:
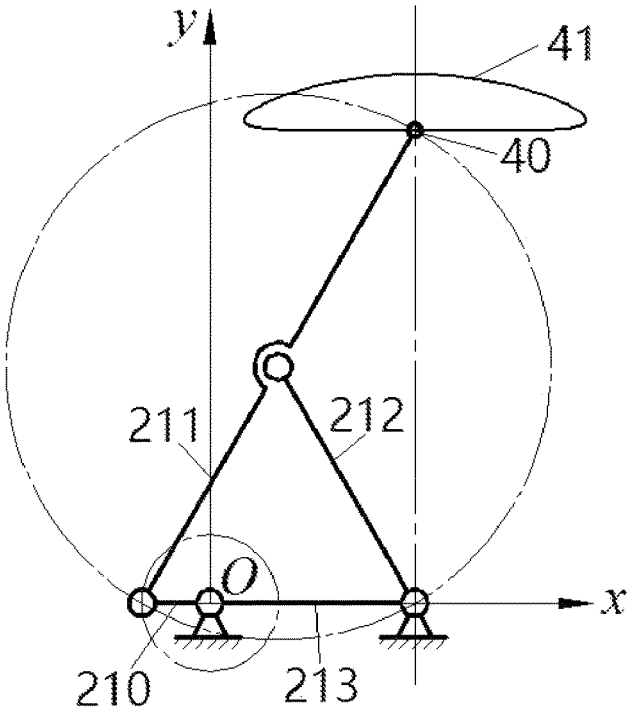
FIG. 3 is a sketch view of a four-bar linkage of a lower-limb walking rehabilitation trainer according to the present invention.

As shown in FIG. 3, the four-bar linkage consists of a crank 210, a first connecting rod 211, a rocking rod 212 and a rack rod 213. The proportional relationship between the rod lengths is designed to be 1:8:4:3. The articulation point on the first connecting rod 211 is the middle point of the rod. The trajectory 41 of the upper end point of the first connecting rod has five-point contact with the horizontal line at the point 40 and presents a long straight line segment, as demonstrated below.

In the coordinate system xOy in FIG. 3, assuming the crank 210 has a length of 1, the equation for the trajectory 41 is $$35721-17010x-1377x^2+1188x^3-9x^4-18x^5+x^6+(855+1188x-90x^2-36x^3+3x^4)y^2+(-81-18x+3x^2)y^4+y^6=0 \quad (1)$$

The trajectory 41 has a coordinate of x=3, y=$4\sqrt{3}$ at the point 40.

By solving the first order derivative of x in the equation (1) for the trajectory 41, we obtain $$W_1 + y'(D_1) = 0, \quad (2)$$

$$\text{where } y' = \frac{dy}{dx}$$

$$W_1 = -2835 - 459x + 594x^2 - 6x^3 - 15x^4 + x^5 + (198 - 30x - 18x^2 + 2x^3)y^2 + (-3 + x)y^4 \quad (3)$$

$$D_1 = (285 + 396x - 30x^2 - 12x^3 + x^4)y + (-54 - 12x + 2x^2)y^3 + y^5 \quad (4)$$

and x=3, y=$4\sqrt{3}$ is substituted into the formula (3) to obtain $W_1$=0, and y'=0 is obtained from the formula (2).

By solving the second order derivative of x in the equation (1) for the trajectory 41, we obtain $$W_2+y'(D_2+D_1')+y''(D_1)=0, \quad (5)$$

where $$W_2=-459+1188x-18x^2-60x^3+5x^4+(-30-36x+6x^2)y^2+y^4 \quad (6)$$

$$D_2=(396-60x-36x^2+4x^3)y+(-12+4x)y^3 \quad (7)$$

x=3, y=$4\sqrt{3}$ is substituted into the formula (6) to obtain $W_2$=0, and y"=0 is obtained from the formula (5).

By solving the third order derivative of x in the equation for the trajectory 41, we obtain $$W_3+y'(D_3+D_2'+D_1'')+y''(D_2+2D'_1)+y'''(D_1)=0, \quad (8)$$

where $$W_3=1188-36x-180x^2+20x^3+(-36+12x)y^2 \quad (9)$$

$$D_3(-60-72x+12x^2)y+4y^3 \quad (10)$$

x=3, y=$4\sqrt{3}$ is substituted into the formula (9) to obtain $W_3$=0, and y'"=0 is obtained from the formula (8).

By solving the fourth order derivative of x in the equation (1) for the trajectory 41, we obtain $$W_4+y'(D_4+D_3'+D_2''+D_1''')+y''(D_3+2D_2'+3D_1'')+y'''(D_2+3D_1')+y^{(4)}(D_1)=0 \quad (11),$$

where $$W_4=-36-360x+60x^2+12y^2 \quad (12)$$

$$D_4=(-72+24x)y \quad (13)$$

x=3, y=$4\sqrt{3}$ is substituted into the formula (12) to obtain $W_4$=0, and $y^{(4)}$=0 is obtained from the formula (2).

By solving the fifth order derivative of x in the equation (1) for the trajectory 41, we obtain $$W_5+y'(D_5+D_4'+D_3''+D_2'''+D_1^{(4)})+y''(D_4+2D_3'+3D_2''+4D_1''')+y'''(D_3+3D_2'+6D_1'')+y^{(4)}(D_2+4D_1')+y^{(5)}(D_1)=0 \quad (14),$$

where $$W_5=-360+120x \quad (15)$$

$$D_5=24y \quad (16)$$

x=3, y=$4\sqrt{3}$ is substituted into the formula (15) to obtain $W_5$=0, and $y^{(5)}$=0 is obtain from the formula (14).

As such, it is proven that the trajectory 41 of the upper end point of the first connecting rod has five-point contact with the horizontal line.

Figure 4:
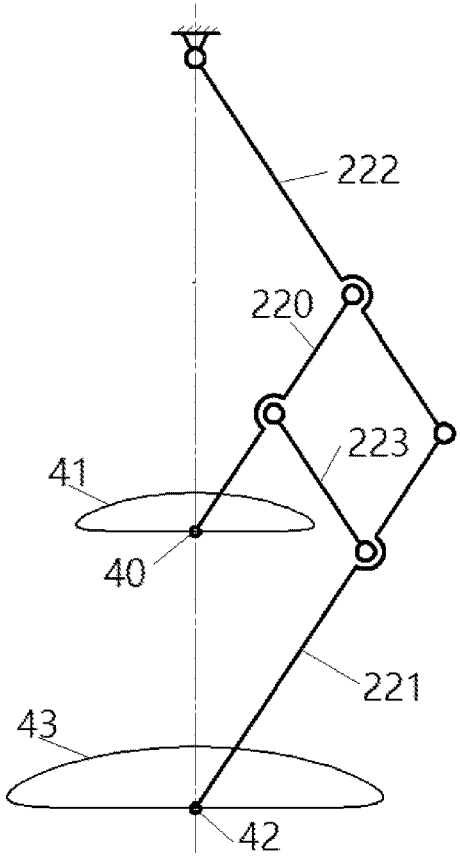
FIG. 4 is a sketch view of a curve amplification mechanism of a lower-limb walking rehabilitation trainer according to the present invention.

Description of the Curve Amplification Mechanism:

To provide gait driving with different strides for patients of different heights, the present trainer amplifies the linkage rod curve generated by a basic four-bar linkage by using an amplification mechanism. This amplification mechanism also serves to shift the gait curve down to adapt to the position of human feet. As shown in FIG. 4, the curve amplification mechanism consists of three rod pieces with a hinge at the middle and a short connecting rod. The relationship of size between the second connecting rod 220, the third connecting rod 221, the fourth connecting rod 222 and the short connecting rod 223 is set to 6:9.5:9.5:3.5 (different size settings corresponding to different amplification factors). The second connecting rod 220 and the third connecting rod 221 are arranged parallel to each other and the short connecting rod 223 and the fourth connecting rod 222 are arranged parallel to each other. The upper end point of the fourth connecting rod 222 is constrained by the fixed hinge. The trajectory 41 of the upper end point of the first connecting rod is amplified by the lower end point of the third connecting rod into a trajectory 43 with an amplification factor of 9.5:6.

The trajectory 43 generated by the curve amplification mechanism has five-point contact with the horizontal straight line, and as the position corresponding to the foot ankle, can ensure that during the time period where maximum force is exerted by the supporting foot in pressing down and striding, the displacement, velocity and acceleration of the ankle of the supporting foot in the direction perpendicular to the ground are zero, thereby effectively preventing additional impact on the foot by the equipment and secondary damage to the limb caused thereby.

Figure 5:
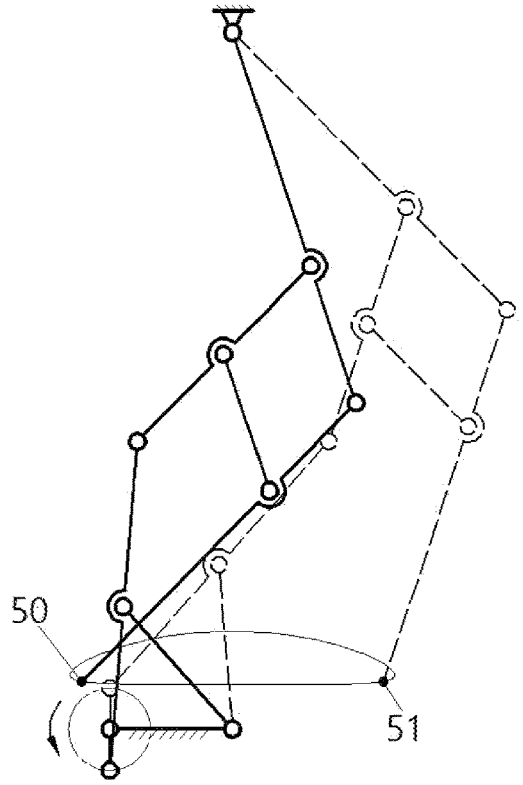
FIG. 5 is a schematic operative view of a lower-limb walking rehabilitation trainer according to the present invention.
Figure 6:
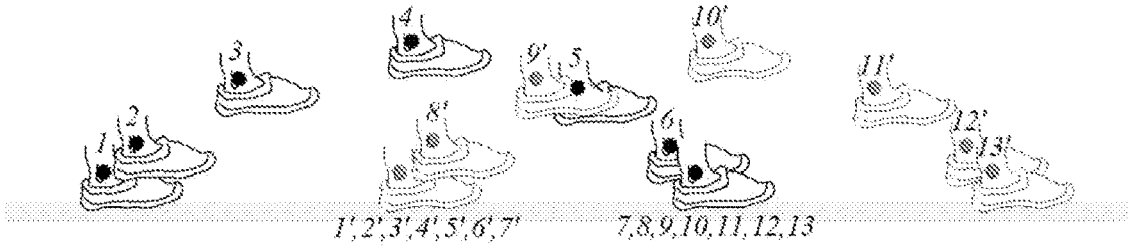
FIG. 6 is a diagram showing the trajectory of foot movement of a lower-limb walking rehabilitation trainer in simulation of walking on the ground according to the present invention.

Description of the Gait Simulation Mechanism:

The gait simulation mechanism consists of two mechanisms with a phase difference of 180° to control the movement of the left and right feet respectively. In FIG. 5, the solid line represents the right foot simulation mechanism, and the dashed line represents the left foot simulation mechanism. The cranks of the two gait simulation mechanisms have a difference in rotational angle of 180°. The trajectories of the right foot movement point 50 and the left foot movement point 51 are in the same form and are similar to the trajectory of the ankle movement of a normal person in "stepping" type walking, that is, a shell like trajectory. The trajectory curve has a segment approximate to a straight line. Approximately, the points 50 and 51 in FIG. 5 are positioned at two ends of the approximate straight line respectively, indicating that at this instant, both feet contact the ground at the same time, whereas at the previous instant, only the right foot contacts the ground and the left foot is in the air in the state of striding and about to land, and at the subsequent instant, the right foot is lifted and the left foot becomes the supporting foot in contact with the ground. By using the movement point as the ankle position to simulate walking on the ground, for each rotation of 30° of the crank, the positions 1-1', 2-2' . . . of the right-left foot are recorded, the results being shown in FIG. 6. In this figure, the thick line represents the right foot and the thin line represents the left foot, showing that the present gait simulation mechanism can well accomplish the alternation of the left and right feet while ensuring equal time of the supporting period and the swinging period in the walking cycle, which conforms to the regular pattern of movement in normal walking of a person.

Figure 7:
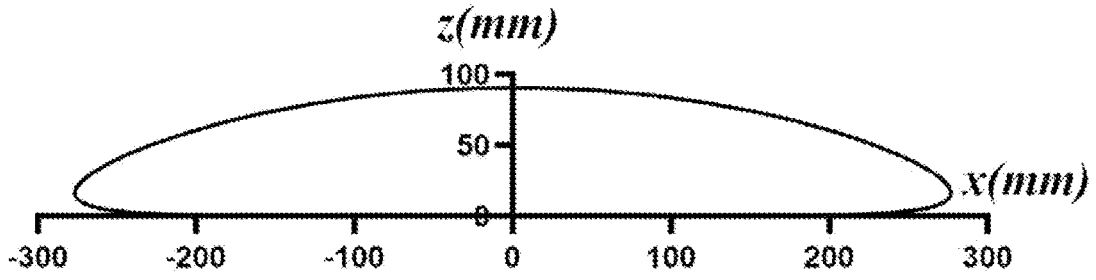
FIG. 7 is a diagram showing the trajectory of foot movement of a lower-limb walking rehabilitation trainer according to the present invention.

Walking Stability Evaluation:

Given the length of the driven crank of 70 mm and the length of the fourth connecting rod in the curve amplification mechanism of 665 mm, the foot ankle has a movement trajectory in a plane perpendicular to the ground as shown in FIG. 7, with a stride of about 600 mm, the lower portion of the trajectory includes a segment approximate to a straight line, and the upwards curve at both ends thereof conform to the posture of foot landing and foot lifting during normal walking.

Figure 8:
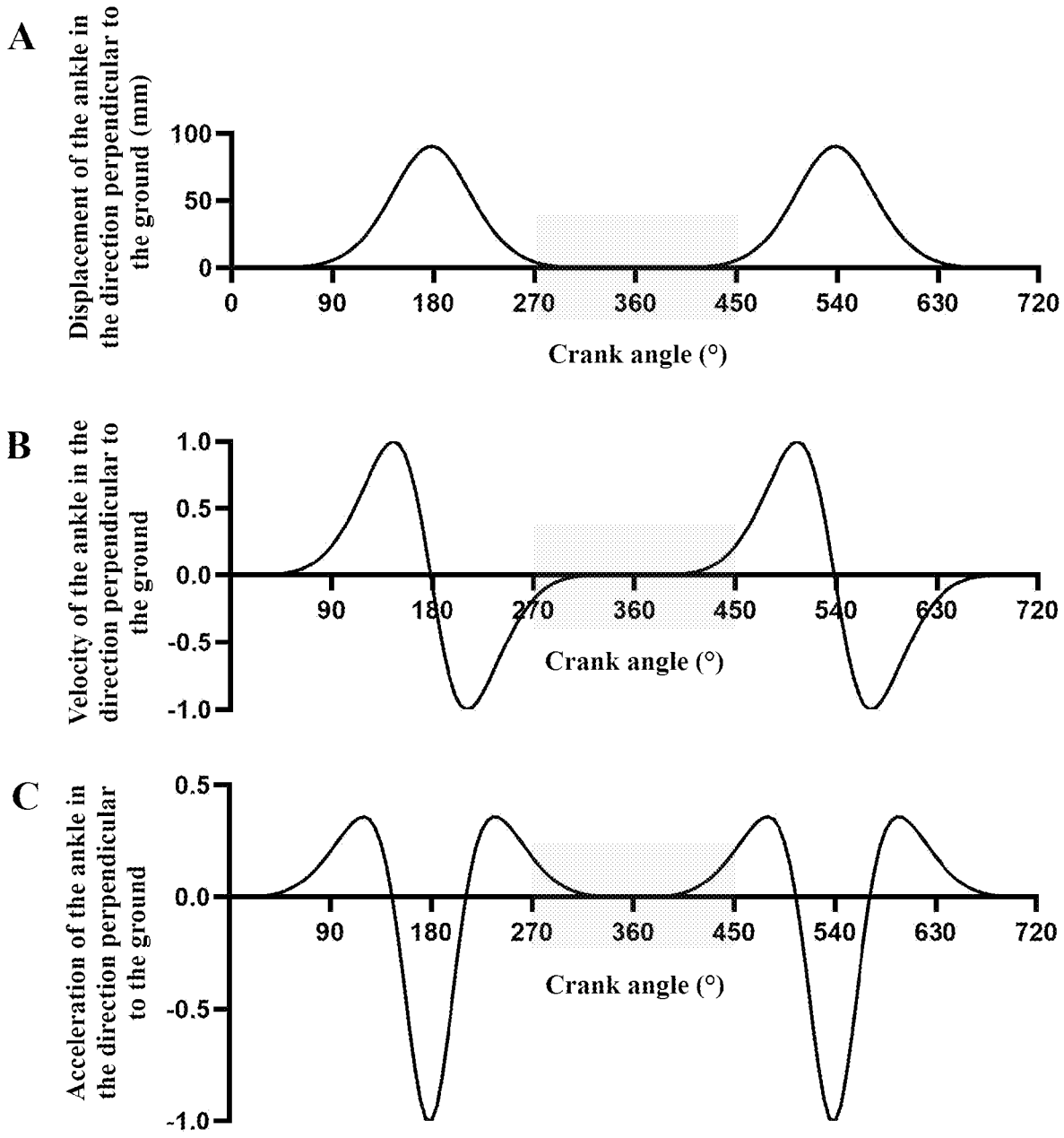
FIG. 8 is a graph showing the regular pattern of foot movement of a lower-limb walking rehabilitation trainer according to the present invention.

The shaded portion of FIG. 8 shows that during the supporting period of the half walking cycle of single-leg stopping, the curves of displacement, velocity and acceleration of the ankle in the direction perpendicular to the ground are within a zero-valued interval, showing that the pedal can guide the supporting foot to be maintained stably at a level that represents the ground without experiencing any impact. As the pressure to the foot bottom from the pedal is similar to the pressure to the supporting leg from the ground, the load bearing ability of the supporting leg gets exercised at this moment. The curve of uniformly varying velocity and acceleration at both ends of this interval represents the process of variation of kinetic energy release and reservation at the later stage of foot landing and early stage of foot lifting and the load bearing during foot landing and the momentum during foot lifting. Such a regular pattern of movement can guide the patient to exercise the strength of leg muscle groups that meet the requirements of walking action and the coordination between them. Furthermore, the curve of regular pattern of movement of the pedals is in high order continuity, showing that the movement guidance for the patient's feet is stable and secure.

Obviously, the embodiments described above are only examples for clear explanation, and are not limitation on the implementation. For those of ordinary skill in the art, it is possible to make other changes or variations in various forms on the basis of the above description. It is not necessary and impossible to exhaust all the embodiments here. However, the obvious changes or variations derived therefrom shall fall within the scope of protection of the present invention.

What is claimed is:

1. A lower-limb walking rehabilitation trainer, comprising two supporting frames, two gait simulation mechanisms installed on the two supporting frames respectively, and two pedals installed on the two gait simulation mechanisms respectively, the two supporting frames both being crutch type supporting frames and the two pedals both being shoe cover type pedals, wherein each of the two gait simulation mechanisms comprises:

a four-bar linkage comprising a crank, a first connecting rod, a rocking rod and a rack rod, a lower end of the first connecting rod being rotatably connected to one end of the crank via a hinge, the other end of the crank being rotatably connected to one end of the rack rod via a hinge, the other end of the rack rod being articulated with a lower end of the rocking rod, an upper end of the rocking rod being connected to a middle point of the first connecting rod via a hinge;

a curve amplification mechanism comprising a second connecting rod, a third connecting rod, a fourth connecting rod and a short connecting rod, a middle point of the second connecting rod being articulated with one end of the short connecting rod, the other end of the short connecting rod being articulated with a body of the third connecting rod, an upper end of the second connecting rod being articulated with a body of the fourth connecting rod, an upper end of the third connecting rod being articulated with a lower end of the fourth connecting rod, the second connecting rod and the third connecting rod being arranged parallel to each other, the short connecting rod and the fourth connecting rod being arranged parallel to each other; and in which an upper end of the first connecting rod in the four-bar linkage is articulated with a lower end of the second connecting rod in the curve amplification mechanism, a lower end of the third connecting rod in the curve amplification mechanism of a respective gait simulation mechanism of the two gait simulation mechanisms is articulated with a respective pedal of the two pedals, the rack rod in the four-bar linkage is fixedly connected to a respective supporting frame of the two supporting frames, respectively, an upper end of the fourth connecting rod in the curve amplification mechanism is connected to an inner side of a respective crutch type supporting frame of the two crutch type supporting frames via a fixed hinge which is vertically aligned with an articulation point of the lower end of the rocking rod.

2. The lower-limb walking rehabilitation trainer of claim 1, wherein a proportional relationship of size between a trajectory generated by the lower end of the third connecting rod in the curve amplification mechanism and a trajectory generated by the upper end of the first connecting rod in the four-bar linkage is 9.5:6.

3. The lower-limb walking rehabilitation trainer of claim 2, wherein a proportional relationship of rod length between the crank, the first connecting rod, the rocking rod and the rack rod is 1:8:4:3.

4. The lower-limb walking rehabilitation trainer of claim 2, wherein a proportional relationship of rod length between the second connecting rod, the third connecting rod, the fourth connecting rod and the short connecting rod is 6:9.5:9.5:3.5.

5. The lower-limb walking rehabilitation trainer of claim 1, wherein the cranks of the two gait simulation mechanisms are in transmission connection with each other via a transmission shaft.

6. The lower-limb walking rehabilitation trainer of claim 5, wherein a rotational angle difference between the cranks of the two gait simulation mechanisms is 180°.

7. The lower-limb walking rehabilitation trainer of claim 5, wherein a driven rotational speed of each of the cranks is adjustable.

8. The lower-limb walking rehabilitation trainer of claim 1, wherein each of the two supporting frames includes a supporting rod, a soft-roll supporting pad installed at an upper end of the supporting rod for underarm support, and an armrest installed at the lower end of the supporting rod, an inner side of the supporting rod being connected to the fourth connecting rod the respective gait simulation mechanism via a fixed hinge.

* * * * *